United States Patent [19]

Wünsch et al.

[11] 4,386,516

[45] Jun. 7, 1983

[54] AUTOMATIC BENDING MACHINE

[76] Inventors: Adolf Wünsch, König-Ludwig-Weg 10, 8962 Pfronten-Obermeilingen; Martin Köpf, Buching, 8959 Lachen 3, both of Fed. Rep. of Germany

[21] Appl. No.: 223,517

[22] Filed: Jan. 8, 1981

[30] Foreign Application Priority Data

Jan. 9, 1980 [DE] Fed. Rep. of Germany ..... 3000532

[51] Int. Cl.[3] ..... B21J 9/10

[52] U.S. Cl. ..... 72/434; 72/450; 100/254; 100/282

[58] Field of Search ..... 72/402, 434, 433, 431, 72/450; 100/282, 254

[56] References Cited

U.S. PATENT DOCUMENTS

| | | | |
|---|---|---|---|
| 2,550,064 | 4/1951 | Ward | 72/450 |
| 2,562,643 | 7/1951 | Saxer | 72/402 |
| 2,562,644 | 7/1951 | Saxer | 72/450 |
| 3,052,277 | 9/1962 | Stegmann | 72/332 |
| 4,026,207 | 5/1977 | Gailus | 72/431 |

FOREIGN PATENT DOCUMENTS

| | | | |
|---|---|---|---|
| 98359 | 3/1923 | Switzerland | 74/434 |
| 547017 | 8/1942 | United Kingdom | 74/434 |

*Primary Examiner*—Gene Crosby

*Attorney, Agent, or Firm*—Angelo Notaro

[57] ABSTRACT

In an automatic bending machine, a plurality of bending tools are arranged around a central working station. Each bending tool is fastened at a slide unit which is operated for reciprocating motion by a driving device. All driving devices are provided with a driving shaft respectively and all driving shafts are in gear engagement with a common central wheel. Each driving device comprises a sealed housing filled with oil and the driving shaft is a crankshaft co-operating with a reciprocating slide via a connecting rod. The slide consists of a pair of slide pieces connected with one another by a lost motion arrangement, the stroke of which can be adjusted from the outside of the housing. The driving device can be used in high speed machines making for example 8,000 strokes per minute and more.

9 Claims, 2 Drawing Figures

AUTOMATIC BENDING MACHINE

BACKGROUND OF THE INVENTION

The present invention relates to an automatic bending machine for the production of multi-form small parts from a metal band or wire, comprising supporting frame means, a central toothed driving wheel mounted in said frame means for rotation about a main axis, a plurality of slide units arranged on said frame means around a central working station, a plurality of bending tools, each one connected with one of the slide units, a plurality of driving devices for reciprocating the respective slide units, a driving shaft mounted for rotation in a housing of each of said driving devices about an axis which is parallel to the main axis, the driving shaft protruding from said housing into said frame means, a pinion fastened at the protruding end of each of said driving shafts and being in engagement with said toothed central wheel.

According to the state of art the driving shaft is provided with a cam plate. A small idle pulley is rotatably mounted on a shaft fixed on the slide unit. By means of a return spring the idle pulley is held in contact with the circumference of the cam plate. Such driving mechanisms have been used in the past in large numbers and operate satisfactory in slow-speed bending machines. However when the operating speed is increased wear at the idle pulley will occur already after a short time. The result is that the bending operations no longer can be precisely performed and when handling precise work pieces waste will be produced.

Therefore one object of the invention is to improve the driving device of the bending machine so that it can be used in connection with high-speed bending machines.

One further object is to provide a new driving device which allows a higher stroke number per minute without any troubles and for a long lifetime.

Another object of the invention is to provide a new driving system avoiding separate driving elements for the work stroke and the return stroke.

One further object is to replace the known cam-follower-arrangement by a completely sealed other system using an oil filling for lubricating the moving parts.

SUMMARY OF THE INVENTION

According to the invention in the bending machine, composed of the features mentioned at the beginning, the housing of the driving device is hermetically sealed and contains an oil filling, the shaft is provided with an eccentrical crank pin, a slide guide track is arranged in the housing in parallel relationship to the moving direction of said slide unit, a slide means is displaceably guided in the slide guide track, a connecting rod connects the crank pin with the slide means, which comprises a rod passing through a packing in a bore of one of the walls of the housing and connected with the slide unit.

The invention brings the advantage that the bending machine can be operated with a much higher speed in the region of 8000 strokes per minute and even more, avoiding any wear or troubles during a long operating time.

If the length of the working stroke must be changes in the known construction the cam plate must be replaced by another one. According to the present invention the slide means consists of a pair of slides serially connected in their moving direction by a lost motion arrangement and a spring is provided holding the slide means in its extended position, whereby the actual extent of the lost motion can be easily and continuously adjusted from outside. Therefore the effective length of the working stroke of the working tool at the slide unit in many cases will be smaller than the stroke of the first slide of the slide means within the housing of the driving device. According to a further feature the prestress of the spring can be continuously adjusted dependent on the bending characteristics of the work pieces.

Further features and advantages can be gained from the following description of an example of the new driving device of an automatic bending machine with reference to the accompanying drawings.

DESCRIPTION OF THE PREFERRED EMBODIMENT

Figure 1:
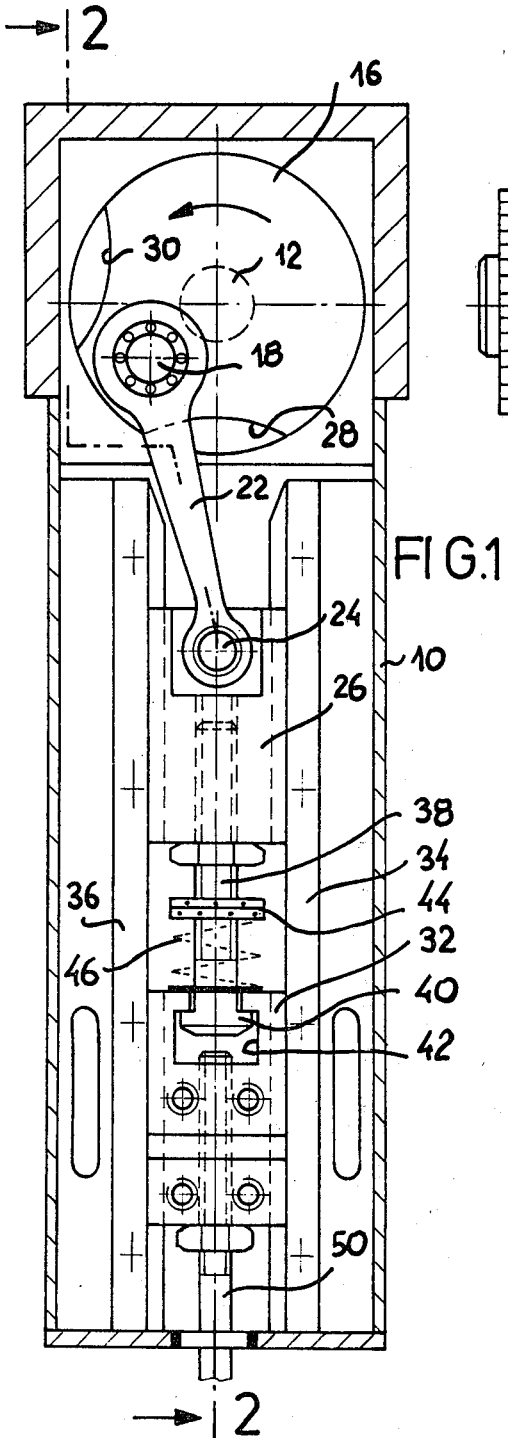
FIG. 1 shows a longitudinal section view of the new driving device for bending tools taken along line 1—1 of FIG. 2.
Figure 2:
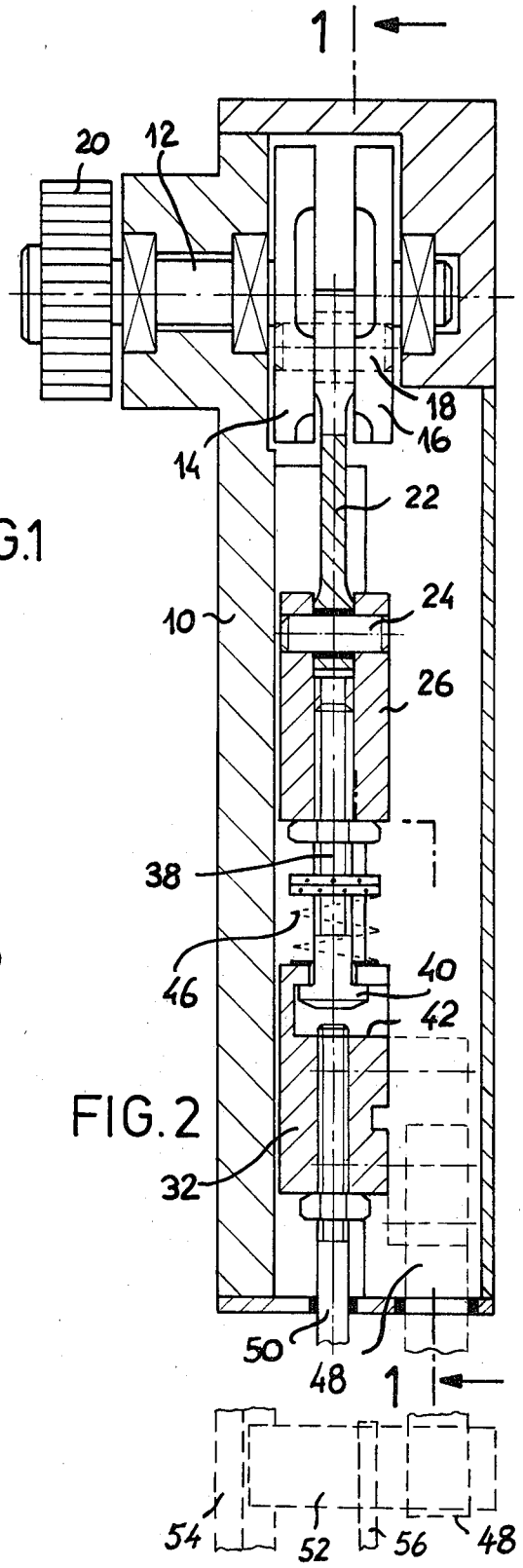
FIG. 2 shows a cross-section view of the driving device taken along line 2—2 of FIG. 1.

A crankshaft 12 is mounted for rotation in a hermetically sealed housing 10 by means of a pair of bearings. A pair of discs 14, 16 are spaced on the shaft and connected by an eccentrical crank pin 18. One end of the shaft 12 protrudes from the housing and at the end of which a pinion 20 is fastened for engagement with a central gear wheel of a bending machine (not shown). At the crank pin 18 a connecting rod 22 is journalled the other end of which being mounted at a first slide 26 by a bolt 24. Recesses 28, 30 are provided at that pair of discs 14, 16 respectively at predetermined positions such that the crankshaft-connecting-rod-arrangement is counterbalanced.

The first slide 26 is connected with a second slide 32 by means of a lost motion arrangement. Both of that slides 26, 32 form a slide arrangement which is mounted for a reciprocating motion in a common slide guide track 34, 36. The lost motion arrangement consists of a thread bolt 38 screwed into a thread hole of the first slide 26 and secured by a screw unit. The bolt 38 protruding from the first slide in the longitudinal direction of the guide track is provided with an enlarged head 40 at its forward end. The bolt extends into a hole 42 of the second slide 32. The head 40 of the bolt is axially displaceable within the hole and at the inlet opening of the hole a neck is formed against which the head of the bolt is pressed by a spring 46 surrounding the bolt 38 and supported between a ring-shaped abutment 44 of the bolt and the rearward face of the second slide 32. The abutment 44 consists of a pair of screw nuts one of which acts as a lock nut. By adjusting the abutment 44 axially the prestress of the spring can be changed. The spring 46 holds the slide arrangement 26, 32 in its extended position.

A connecting rod 48 is fastened at the second slide and extends through a bore of the front wall of the housing 10. A packing is inserted in the bore providing tightness. The protruding forward end of the connecting rod 48 is fastened at a slide unit 52 displaceable in a guide 54 and carrying the bending tool 56.

A thread portion of an adjusting rod 50 extends through a thread bore of the second slide 32 into the hole 42 thus forming an adjustable abutment for the head bolt 38. The rod 50 extends through the front wall of the housing and a seal is provided avoiding leakage. The rod is locked in a predetermined axial position by a lock nut as shown or by a suitable known lock arrangement outside of the housing preventing turning of the rod 50.

The rod 50 has a double-function. First by turning the rod the extent of the lost motion can be continuously adjusted. Second the outward end of the rod co-acts with an adjustable abutment (not shown) arranged on the frame of the bending machine in order to define the forward dead position of the bending tool.

Many simple bending operations can be performed with the working stroke provided by the first slide 26. In these cases the adjusting rod is screwed into the hole 42 until it contacts the head 40 of the bolt 38, whereby both of that slides 26, 32 will move as a unit. If a smaller stroke length is desired the adjusting rod is set to provide for a relative movement between the pair of slides and a abutment outside of the housing is adjusted to limit the movement of the slide 32. This can be done by the adjusting rod 50 itself abutting against the abutment fastened at the frame of the bending machine or by a protrusion fastened at the connecting rod 48.

Many bending processes require a longer rest period of the bending tool in the end position. If the slide arrangement would move as a unit the bending tool only momentarily would remain in its end position. However by means of the differential effect of the slide arrangement provided with a lost motion of predetermined extent the rest period can be increased. In all these cases the spring force must be great enough to effect the bending.

Other bending processes require small stroke lengths in very short time periods and with highest bending forces of the bending tool. This can be achieved by the new driving device, if a spring with a low spring resistance is used. In this case at the beginning of the working stroke of the first slide the second slide remains in its rest position and the spring is compressed until the head of the bolt of the first slide abuts against the adjusting rod of the second slide so that the latter is moved only by a small extent but with highest force.

It is to be pointed out that the crankshaft can be replaced by another one having a larger or a lower eccentricity of its crank pin. Thereby not only the stroke lengths can be varied but also different accelerations are achieved. By using only a part of the working cycle of the shaft the bending tool can be displaced during short periods with a high acceleration.

The new driving device allows a very high machine speed in the region of 10,000 strokes per minute. The disadvantages of the cam plate-follower-arrangement in which each cam plate must be especially designed and produced for a predetermined movement of the bending tool and the requirement of a second cam plate or a return spring for the return stroke of the bending tool are avoided by the new driving device which furthermore allows a great variety in controlling the movement of the bending tool namely different eccentricities of the crank pin, adjustment of the lost motion extent between the pair of slides, limitation of the working stroke of the second slide, use of springs having different resiliencies, and alteration of the prestress of the spring.

It should be clear that the afore-mentioned adjustment operations within the housing of the driving device are performed when the bending unit is set up and before the housing is closed and filled with oil.

What I claim is:

1. In an automatic bending machine for the production of multi-form small parts from a metal band or wire, a driving device for reciprocating a slide unit carrying a bending tool comprising a housing, a drive shaft mounted for rotation in said housing and protruding therefrom, a pinion fastened at the protruding end of said driving shaft, the housing being hermetically sealed and containing an oil filling, the shaft being provided with an eccentrical crank pin, a slide guide-track arranged in the housing in parallel relationship to the moving direction of said slide unit, a slide means displaceable in the slide guide track, a connecting rod connecting the crank pin with the slide means, the slide means comprising a rod passing through a packing in a bore of one of the walls of the housing and connected with the slide unit.

2. The combination as claimed in claim 1, wherein the shaft is mounted in at least one pair of bearings in the housing and is provided with a balance weight.

3. The combination as claimed in claim 1, wherein the shaft is provided with a pair of discs connected by said crank pin.

4. The combination as claimed in claim 1, wherein the slide means consists of a pair of slides serially connected in their moving direction by a lost motion arrangement and a spring is provided holding the slide means in its extended position.

5. The combination as claimed in claim 4, wherein a threaded bolt protrudes from one slide of said pair of slides in the longitudinal direction of the slide guide track and is provided with an enlarged head extending into a hole of the other slide of said pair of slides, the hole having a neck of reduced diameter and a length greater than the height of the head, and wherein the bolt is provided with an abutment between which and the other slide the spring is inserted surrounding the thread bolt and biasing the head of the bolt against said neck.

6. The combination as claimed in claim 5, wherein the bottom face of the hole defining the effective length of which is adjustable.

7. The combination as claimed in claim 5, wherein the abutment is adjustable in axial direction of the bolt.

8. The combination as claimed in claim 6, wherein an adjusting rod is provided with a threaded portion which is adjustably screwed into the other one of said pair of slides and extends into said hole of which forming the bottom surface of said hole.

9. The combination as claimed in claim 8, wherein the adjusting rod is passed through the front wall of the housing and is provided with locking means to secure the rod in a predetermined position.

* * * * *